United States Patent [19]

Ito et al.

[11] Patent Number: 4,778,782

[45] Date of Patent: Oct. 18, 1988

[54] HEAT TRANSFERABLE SHEET

[75] Inventors: Yoshikazu Ito; Masanori Akada; Hitoshi Arita, all of Tokyo, Japan

[73] Assignee: Dai Nippon Insatsu Kabushiki Kaisha, Tokyo, Japan

[21] Appl. No.: 18,517

[22] Filed: Feb. 25, 1987

[30] Foreign Application Priority Data

Feb. 25, 1986 [JP] Japan ..... 61-39789

[51] Int. Cl.[4] ..... B41M 5/035; B41M 5/26

[52] U.S. Cl. ..... 503/227; 8/471; 427/146; 427/288; 428/195; 428/211; 428/315.5; 428/315.9; 428/318.4; 428/319.9; 428/513; 428/537.5; 428/913; 428/914

[58] Field of Search ..... 428/195, 913, 914, 211, 428/315.5, 315.9, 318.4, 319.3, 319.7, 319.9, 513, 537.5; 8/470, 471; 503/227; 427/146, 256, 288; 430/200, 201, 945

[56] References Cited

U.S. PATENT DOCUMENTS

| | | | |
|---|---|---|---|
| 4,075,050 | 2/1978 | Takashi et al. | 428/315.5 |
| 4,318,950 | 3/1982 | Takashi et al. | 428/143 |
| 4,572,860 | 2/1986 | Nakamura et al. | 8/471 |
| 4,615,938 | 10/1986 | Hotta et al. | 428/328 |
| 4,619,665 | 10/1986 | Sideman et al. | 8/471 |

FOREIGN PATENT DOCUMENTS

| | | | |
|---|---|---|---|
| 1116581 | 6/1986 | Japan | 503/227 |

*Primary Examiner*—Bruce H. Hess

*Attorney, Agent, or Firm*—Parkhurst, Oliff & Berridge

[57] ABSTRACT

A heat transferable sheet which is to be used in combination with a heat transfer sheet, comprising (a) a substrate sheet and (b) a receptive layer formed on at least one surface of the substrate sheet for receiving dye which has migrated from said heat transfer sheet during heating printing, characterized in that said substrate sheet comprises a laminate having a synthetic paper laminated on at least one surface of a core material and said receptive layer is provided directly or over an intermediate layer on the surface of the substrate sheet on the side where the synthetic paper exists.

16 Claims, 1 Drawing Sheet

HEAT TRANSFERABLE SHEET

BACKGROUND OF THE INVENTION

This invention relates to a heat transferable sheet or a sheet to be heat transfer printed, more particularly to a heat transferable sheet to be used in combination with a heat transfer sheet for performing image formation by heating printing means such as thermal head.

In the prior art, as methods for forming printed images according to the heat transfer method, the following methods have been proposed. That is, various studies have been made on the method in which, by the use of a heat transfer sheet comprising a heat transfer layer containing a meltable or sublimatable dye formed by heating on a substrate sheet and a heat transferable sheet having a receptive layer for receiving the dye which as migrated from the heat transfer sheet, superposing these sheets so that the heat transfer layer will contact the receptive layer, and imparting heat energy by means of a spot heating means such as a thermal head, which generates heat corresponding to the image information from the back side of the heat transfer sheet, the dye in the heat transfer layer is transferred to the receptive layer and images of natural color photographic tone are obtained.

For heat transferable sheets to be used for such purpose, we have made various proposals in which receptive layers such as of saturated polyesters are used on the surface of synthetic papers.

A heat transferable sheet having a synthetic paper as a substrate sheet has excellent strength and flexibility as compared with a heat transferable sheet having a conventional paper as the substrate sheet but, on the other hand, it has the following problems. The heat transferable sheet as mentioned above, of which, the synthetic paper itself is used for the substrate sheet is constituted of resin components with relatively low heat resistance such as polyolefin resins, suffers from residual strain caused in the substrate sheet by the heat energy applied during image formation, whereby a problem arises in that the heat transferable sheet is curled after image formation.

SUMMARY OF THE INVENTION

The present invention has been accomplished in view of the problems described above, and an object thereof is to provide a heat transferable sheet which can prevent effectively the generation of curling after image formation and enable formation of a well finished image with excellent flatness.

More specifically, the heat transferable sheet according to the present invention is a sheet to be used in combination with a heat transfer sheet, comprising (a) a substrate sheet and (b) a receptive layer formed at least on one surface of the substrate sheet for receiving the dye which has migrated from said heat transfer sheet during heating printing, characterized in that said substrate sheet comprises a laminate having a synthetic paper laminated on at least one surface of a core material, and said receptive layer is provided directly over an intermediate layer on the surface of the substrate sheet on the side where the synthetic paper exists.

Thus, in the heat transferable sheet of the present invention, since the substrate sheet comprises a laminate of a synthetic paper and a core material, substantially no heat shrinkage occurs by heating with a thermal head, during transfer, and consequently substantially no curling is generated after image formation. Thus inconveniences caused by generation of curling in the heat transferable sheet of the prior art can be eliminated.

DETAILED DESCRIPTION OF THE INVENTION

Figure 1:
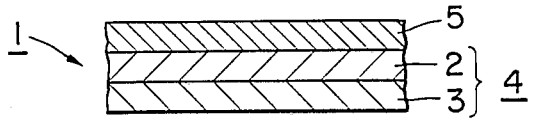
FIG. 1 through FIG. 7 are sectional views respectively showing examples of the heat transferable sheet of the present invention.

As shown in FIG. 1, the heat transferable sheet of the present invention comprises basically a substrate sheet 4 comprising a laminate of a synthetic paper 2 and a core material 3 and a receptive layer 5 formed on the surface of the substrate sheet on the side of the synthetic paper 2. Also, in this example, although not shown, an intermediate layer can be also interposed between the synthetic paper 2 and the receptive layer 5.

Figure 2:
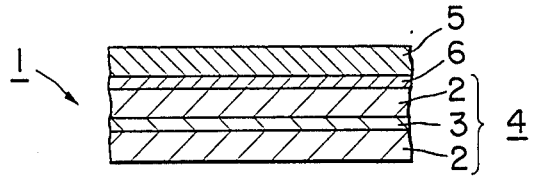

FIG. 2 is an example in which the substrate sheet is constituted by providing sheets of synthetic paper 2 on both surfaces of the core material 3, and also a receptive layer 5 is provided on the surface of the synthetic paper 2 through an intermediate layer 6.

Materials which have been found to be suitable for use in the heat transferable sheet of this invention will now be described in detail.

Substrate sheet

The core material 3 is an important member for preventing curling of the substrate sheet by combination with the synthetic paper 2 and may be constituted of a cellulose fiber paper, a plastic film or a laminate thereof.

Examples of the above cellulose fiber paper are fine papers, coated papers, cast-coated papers, backing papers for wall covering, synthetic resin or emulsion saturated papers, synthetic rubber latex saturated papers, synthetic resin internally added papers, boards, dimensionally stable papers, and various base papers for recording papers (e.g., base papers for off-set master paper, base papers for photographic printing).

Among these, cast-coated papers are papers having smooth and high gloss surface obtained by coating the surface of base papers with a pigment-coating mixture, pressing a chromium-plated drum having a mirror surface against the coated layer while it is in a wet state, and peeling it off after drying.

Examples of the plastic film to be used as the core material are films of polyolefin, polyvinyl chloride, polyethylene terephthalate, polystyrene, methacrylate, and polycarbonate.

Also, as the above core material 3, it is possible to use the above cellulose fiber paper which has been extrusion coated with polyolefin, etc. For obtaining good curling prevention effect, the core material 3 should preferably have a thickness of 30 to 500 μm.

In this connection, when a cellulose fiber paper is used as the core material, if a synthetic paper as described below having a thickness of about 60 μm is laminated on the core material, the unevenness of the surface of the cellulose fiber paper will also appear on the surface of the synthetic paper. For this reason, if an image is formed on a heat transferable sheet by the use of such a substrate sheet, its influence may also appear on the printed image, whereby the image may become rough particularly in the intermediate density region.

Accordingly, particularly for use in the case of obtaining a dense image, it is preferable to use a cellulose fiber paper having a surface smoothness (Bekk smoothness) of 1,000 sec., or more desirable 2,000 sec. or more. Papers having such high surface smoothness may include coated papers. Further, when the image characteristics are highly appreciated to be important, it is preferable to use various coated papers such as cast-coated papers, or those which have been subjected to super-calendering treatment. Also, as shown in FIG. 2, the thickness of the core material in the case of laminating synthetic papers on both surfaces of the cellulose fiber paper as the core material, which is suitably determined depending on the thickness of the synthetic paper and the heat transferable sheet which is the final product, is generally 50 to 200 μm.

Also, when a base paper with great unevenness on the surface of the cellulose fiber paper (e.g., fine paper) is used as the core material and the surface smoothness of the receptive layer surface is low, the surface smoothness may be made 2,000 sec. or more by applying super-calendering treatment after provision of the receptive layer.

As the synthetic paper to be laminated on the core material, a synthetic paper having a paper-like layer containing microvoids is particularly preferred. Generally speaking, synthetic papers are paper-like sheets obtained from synthetic polymeric materials as starting materials and may be broadly classified into the two of film papers obtained by application of coating or a surface paper-making treatment onto a film and fiber-papers obtained by paper making of synthetic pulp. In the present invention, among them, film-papers having microvoids on the surface are desirable. For example, pigment-filled low-density extruded films may be preferably used. This film can be obtained by stretching a translucent plastic film containing fine fillers such as clay, talc, etc. By this stretching, the bonds between the polymers and fillers in the film are destroyed, whereby microvoids are considered to be formed in the film. The microvoids lower the density of the film, and also make it appear white and opaque.

Also, such a synthetic paper may comprise a laminate of a paper-like layer having microvoids as mentioned above and a core layer having no voids. In this case, for example, the two paper-like layers on the outer surface can be obtained by stretching a pigmented polypropylene-polyethylene mixture in one direction, and the core layer at the center can be a nonporous, biaxially-oriented polypropylene. In this case, the overall density of the synthetic paper is preferably 0.70 to 0.85.

Such synthetic papers are disclosed in, for example, U.S. Pat. No. 3,841,943.

When an image is formed by thermal transfer, the heat transferable sheet obtained by use of a synthetic paper as described above has the effect of having high image density without occurrence of variance of images. This may be considered to be due to the heat insulation effect of the microvoids to afford good thermal energy efficiency as well as good cushionness by the microvoids provided on the above synthetic paper which contribute to the receptive layer on which the image is formed. It is also possible to provide the paper-like layer containing the above microvoids directly on the surface of the core material 3.

Receptive layer

The receptive layer 5 functions to receive sublimitable dyes which have migrated from the heat transfer sheet and is provided on the above substrate 4. Examples of the material for this receptive layer 5 include the following synthetic resins.

(1) Those having ester bonds;

Polyester resin, polyacrylate resin, polycarbonate resin, polyvinyl acetate resin, styrene-acrylate resin, and vinyltolueneacrylate resin.

(2) Those having urethane bonds:

Polyurethane resins.

(3) Those having amide bonds:

Polyamide resins (nylon).

(4) Those having urea bonds:

Urea resin.

(5) Those having other bonds of high polarity:

Polycaprolactam resins, styrene resins, polyvinyl chloride resins, vinyl chloride-vinyl acetate copolymer resins, and polycrylonitrile resin.

In addition to the above resins, mixtures of these resins or copolymers can be also be used.

Alternatively, the receptive layer can be constituted of a mixed resin of a saturated polyester and a vinyl-chloride-vinyl ester copolymer. Examples of the saturated polyester are Vylon 200, Vylon 290, Vylon 600 and the like (all are produced by Toyobo Co., Ltd., Japan), KA-1038C (produced by Arakawa Chemical Ind., Ltd., Japan), and TP220, TP235 (all produced by Nippon Synthetic Chemical Ind. Co. Ltd., Japan). The vinyl chloride-vinyl acetate copolymer should contain a vinyl chloride content of 85 to 97 wt. % and have a polymerization degree of about 200 to 800. The vinyl chloride-vinyl acetate copolymer is not necessarily limited to copolymers containing only vinyl chloride component and vinyl acetate component but may also contain vinyl alcohol component, maleic acid component, etc., within a range which does not interfere with the objects of the present invention.

The receptive layer may also be constituted of a polystyrene type resin, for example, polystyrene type resins comprising homopolymers or copolymers of styrene type monomers such as styrene, α-methylstyrene, vinyltoluene, or styrene type copolymer resins of said styrene-monomers with other monomers, for example, acrylic or methacrylic monomers such as acrylate, methacrylate, acrylonitrile, methacrylonitrile and the like or a maleic anhydride.

Alternatively, in the present invention, instead of using a receptive layer constituted merely by use of a synthetic resin as described above, a receptive layer having a sea-island structure as described below can be also used.

For example, a first region of the receptive layer may be formed of a synthetic resin having a glass transition temperature of −100° to 20° C. and a second layer region of the receptive layer formed of a synthetic resin having a glass transition temperature of 40° C. or higher respectively to cause both of the first and second regions to be exposed on the surface of the receptive layer 5, and the first region is made 15% or more of the surface simultaneously with formation of the first region in shape of islands independent of each other, with the length in the longer direction of each island portion being preferably made 0.5 to 200 μm.

In the above receptive layer, in order to further enhance sharpness of the transferred image by increasing the whiteness of the receptive layer and also enhance the writing characteristic, extender pigments such as silica, calcium carbonate, titanium oxide, and zinc oxide can be also contained, if desired. These extender pigments can also be contained in order to cause the surface of the receptive layer to assume a matte state.

Figure 3:
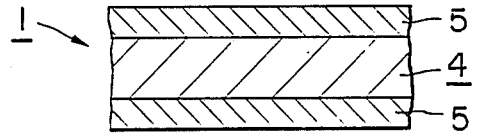

Also, in the present invention, as shown in FIG. 3, the receptive layer 5 may be provided on both surfaces of the substrate sheet 4. However, the above synthetic resins with high dyeability of dyes have generally lower glass transition points, and therefore when heat transferable sheets having receptive layers constituted of such synthetic resins on both surfaces are superposed on one another, blocking is liable to occur mutually therebetween at a high temperature or high humidity (adhering through tackiness of the surface to become unpeelable or form marks of peel-off even when peeled off).

Therefore, provided that the front and back of a heat transferable sheet are discriminable and the sheets are always superposed on one another in the same direction, it is preferable to make one of the surfaces non-blocking or alternatively to make the front and back surfaces contacting each other mutually non-blocking.

However, when the front and the back are not discriminable, or when there is no quarantee that the sheets are not always superposed in the same direction, even if the front and back may be discriminable, it is necessary to make both surfaces non-blocking.

For making the receptive layer itself on one surface or the receptive layers themselves on both surfaces nonblocking, the following methods (a) to (c) can be used.

(a) The method in which the resin itself constituting the receptive layer is selected from those having higher blocking temperatures. Specifically, this is the method in which a resin having a higher glass transition point, or a cellulose type resin (e.g., nitrocellulose resin) which will not readily cause blocking is mixed with a resin with high dyeability of dyes. When a resin having a high glass transition point is used, since printing is difficult, it is desirable to supply more heat from a thermal head or to heat the heat transferable sheet prior to printing. Alternatively, the treatment of improving dyeability by heating after printing is also preferably practiced.

(b) The method in which an extender pigment is contained in a resin with high dyeability of dyes. According to this method, an extender pigment such as fine powdery silica, alumina, kaolin, clay, calcium carbonate, titanium dioxide, barium sulfate, and zinc oxide is dispersed in a resin. According to this method, depending on the extender pigment used, the whiteness of the receptive layer is improved. Improvement of whiteness is described hereinafter.

(c) The method in which a mold release agent is contained in a resin with high dyeability of dyes. According to this method, a resin and a mold release agent are mixed by dissolving, and the solution is coated and dried to form a receptive layer alternatively, the mold release agent may also be applied on the resin containing no mold release agent already formed. According to this method (c), as described above, the mold release agent also exhibits the mold release effect between the heat transfer sheet and the heat transferable sheet during printing. The mold release agent is described below.

Separately from the methods for making the receiving layer non-blocking, there is also the method in which the resin constituting the receiving layer of one surface is made different from the resin constituting the receiving layer of the other surface, whereby no blocking occurs even when the heat transferable sheets are superposed on one another, with the receiving layer on the back surface of the sheet on the upper side contacting the receptive layer of the front surface of the sheet on the lower side. In the present specification, the case when no blocking occurs by contact mutually between such different resins, even if the respective resins are susceptible to blocking, is called "mutually nonblocking".

As specific combinations of the resins, from among the synthetic resins constituting the receptive layer as mentioned above, any two kinds of the resins may be selected, and they be separately used for the purpose of constituting the receptive layers of one surface and the other surface. Also, instead of 2 kinds, 3 kinds or more may be selected and suitably used separately. For example, the resin A, the resin B and the resin C may be selected, and A and B are used on one surface, while C on the other surface. Thus, when a plural number of resins are used as a mixture, if one resin is low in blocking property, that resin can be used also on both surfaces. For example, in the above example, when the resin is low in blocking property, the receptive layer of one surface may be constituted of A and C, while the receptive layer of the other surface of B and C.

Intermediate layer

The receptive layer 5, in addition to direct provision on the substrate 4, can also be provided over an intermediate layer 6 on the substrate 4 as shown in FIG. 2.

The material for the above intermediate layer 6 may include organic solvent solutions of saturated polyesters, polyurethanes, acrylates, etc. As a method for forming the intermediate layer 6, reverse roll coating, gravure coating or wire bar coating, etc., may be employed, and the thickness of said intermediate layer 6 is preferably 3 to 15 $\mu$m.

As the material for the intermediate layer 6, in place of the above organic solvent solution of the synthetic resin, it is also possible to use either one or both of an aqueous solution of a water-soluble synthetic resin and an aqueous emulsion of a synthetic resin. As the water-soluble synthetic resin, (1) polyacrylamide, (2) various resins such as polyethylene, polyvinyl acetate containing carboxylic groups, (3) cellulose type resins, etc., can be used. As the synthetic resin emulsion, aqueous emulsions of synthetic resins such as polyacrylates, ethylene-vinyl acetate copolymers, polyurethane, polyester can be used. Also, the above water-soluble synthetic resin and the aqueous emulsion of synthetic resin can be used as a mixture. As the method for forming the intermediate layer 6 by use of a water-soluble synthetic resin or an aqueous emulsion, the coating means as mentioned above can be used, or otherwise the air knife coating method can be used.

Into the intermediate layer 6 may be also added extender pigments such as titanium oxide, zinc ozide, clay, and calcium carbonate for coating adaptability of the coating material during formation, anti-blocking property of the coated film and improvement of shielding property. In this case, the above extender pigment should preferably be made not more than 30 parts by weight based on 100 parts by weight of the resin solid in the intermediate layer 6.

In the present invention, by forming such an intermediate layer as described above, adhesion between the heat transfer sheet and the heat transferable sheet can be further improved. The reason for this may be considered to be deformation of the intermediate layer itself on account of its low rigidity due to the pressure during printing. Further, it may be estimated that the resin as described above has generally lower glass transition point and softening point, whereby its rigidity is further lowered than at normal temperature by the heat energy imparted during printing to become more deformable, thus contributing to improvement of adhesion.

Resin layer

Figure 4:
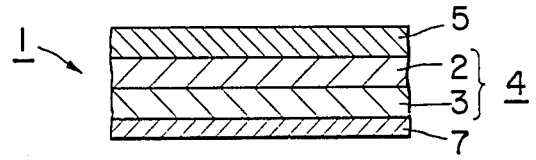

The heat transferable sheet 1 of the present invention can provide a resin layer 7 on the surface of the core material 3 where no synthetic paper 2 is provided as shown in FIG. 4. The resin layer 7 plays primarily a reinforcing role in preventing curling when the core material 3 is provided only on one surface of the synthetic paper 2, and also has the excellent effect of imparting lubricity which makes it easier to take out the heat transferable sheet 1 one by one during transfer.

The resin layer 7 can be formed by coating and drying of a liquor of a binder such as organic solvent solutions of methacrylate resins, methyl methacrylate resins, vinyl chloride-vinyl acetate copolymer resins, or their emulsions, synthetic rubber latex, etc., containing, if necessary, fillers such as clay, calcium carbonate, silica titanium oxide, and talc, added thereinto. As the coating method, means such as wire bar coating, air knife coating, and reverse roll coating can be employed, and its coated amount is suitably selected depending on curl balance. Also, the resin layer 7 can be provided by extrusion coating of polyolefins, etc.

Antistatic layer

Figure 5:
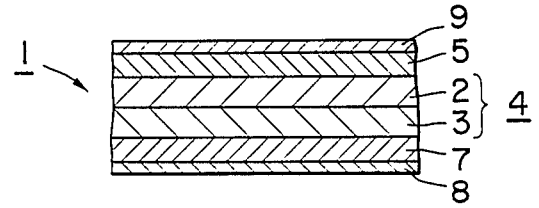

In the heat transferable sheet of the present invention, an antistatic layer 8 can be provided on the substrate 4 on the side where the receiving layer 5 is not provided, as shown in FIG. 5. For example, it can be provided directly in contact with the substrate 4, or, when the above resin layer 7 is formed as shown in FIG. 5, it can also be provided on the surface of the resin layer 7. The above antistatic layer 8 can also be provided, when the resin layer is formed, by mixing an antistatic agent into the resin for forming the resin layer 7 and permitting said antistatic agent to bleed onto the surface of the resin layer 7, thus being consequently provided on the resin layer 7.

Examples of the antistatic agent are surfactants, for example, cationic surfactants (e.g., quaternary ammonium salt, polyamine derivative), anionic surfactants (e.g., alkylphosphate), amphoteric surfactants or nonionic surfactants. The antistatic layer 8 can be formed by coating by use of the above surfactant according to gravure coating, bar coating, etc.

In the case when the antistatic effect is insufficient when only the surface opposite to the receptive layer is coated with the antistatic agent, it can be also supplemented by coating the receptive layer surface with a diluted solution of an antistatic agent.

Mold release layer

In the heat transferable sheet of the present invention, if necessary, a mold release agent layer can be formed on the surface of the receiving layer for the purpose of improving mold release property from the heat transfer sheet after image formation. For example, as shown in FIG. 5, a mold release agent layer 9 can be provided on the surface of the receptive layer 5, and also a mold release agent can be contained in the receptive layer 5, although not particularly shown. Further, it is also possible to incorporate a mold release agent in the receptive layer 5, and thereafter to permit the mold release agent to bleed onto the surface of the receptive layer 5, thus providing consequently a mold release agent layer on the surface of the receptive layer 5. As the material for the above mold release agent layer 9, solid waxes such as polyethylene wax, amide wax, of Teflon powder; fluorine type, phosphate type surfactants; silicone oils, preferably silicone oils can be used. For the above silicone oil, although an oily type may be available, a curing type is preferred. As the silicone oil of the curing type, the reaction curing type, the light curing type, or the catalyst curing type can be used, but the reaction curing type silicone oil is particularly preferred. As the reaction curing type silicon oil, those obtained by the reaction curing of an amino-modified silicone oil and an epoxymodified silicone oil are preferred. When the above mold release agent of the curing type silicone oil is contained in the receptive layer 5, its amount added is preferably 0.5 to 30 wt. % of the resin constituting the receptive layer 5. The thickness of the mold release agent layer 9 should preferably be 0.01 to 5 $\mu$m, particularly 0.05 to 2 $\mu$m.

Non-receptive layer for writing

The above heat transferable sheet, when writing or sealing is to be carried out with a pencil, an aqueous ink pen, etc. on the surface of the above sheet when used, for, for example, cards, picture mail cards, etc., involves a problem in that it has poor writing characteristic and also is not suitable for sealing, because the sheet surface is a receptive layer surface as described above. For this reason, in the present invention, it is also possible to provide a non-receptive layer for writing on the surface of the heat transferable sheet.

Figure 6:
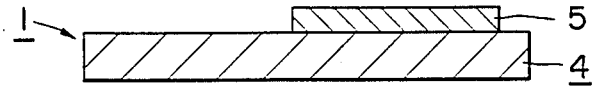

That is, in the heat transferable sheet of the present invention, as shown in FIG. 6, the receptive layer 5 may be provided on a part of the substrate sheet 4. In the case of this example, the portion where the receptive layer 5 is not provided becomes the non-receiving layer for writing.

Figure 7:
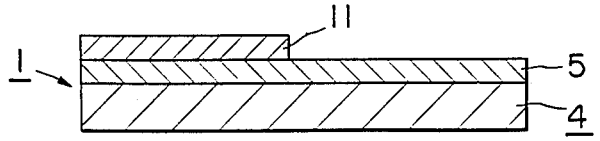

As still another embodiment of the invention, as shown in FIG. 7, the receptive layer 5 is provided on the whole surface of the substrate sheet 4, and further a non-receptive layer 11 can be provided partially on the surface of the receptive layer 5.

As the material for the above non-receptive layer 11, an ink comprising a mixture of an extender pigment such as titanium oxide, zinc oxide, clay, silica fine particles, and calcium carbonate in a vehicle of an acrylate, saturated polyester, vinyl chloride-vinyl acetate copolymer, etc., can be used. As the method for forming the non-receptive layer 11, gravure printing, reverse roll coating by use of a gravure plate, screen printing, etc., may be employed, and the non-receptive layer 11 can be formed by the above forming method at the portion where writing, sealing, etc., are necessary on the receptive layer 5. The thickness of the non-receptive layer 11 is preferably 2 to 10 $\mu$m.

Others

In the heat transferable sheet of the present invention, if necessary, a separate lubricating layer can be provided for making it easier to take out said sheets one by one. This lubricating layer can be provided on the lowermost layer (opposite to the side of receptive layer) of the heat transferable sheet so that the heat transferable sheets adjacent to each other will be mutually and readily slidable.

As the material for the lubricating layer, metacrylate resins such as methyl methacrylate, corresponding acrylate resins, vinyl resins such as vinyl chloride/vinyl acetate copolymer resins, etc., can be employed, and it can be formed by coating according to the same coating method as in the receptive layer 5, followed by drying. Particularly in the case when enhanced lubricity is desired, it is also possible to mix lubricant powders such as polyethylene wax and Teflon powder (the above resin layer can be also made to function as the lubricating layer.)

Further, the heat transferable sheet 1 of the present invention can also have photoelectric tube detection marks detectable with a photoelectric tube detecting device, etc., provided on one surface of said sheet, preferably on the back surface. By providing the above marks, the heat transferable sheet 1 can be accurately set at a desired position through registration by means of a photoelectric tube detecting device, etc., during transfer, whereby the image can be formed always at a correct desired position. In addition, there are still other advantages in working operations when performing practically transfer by use of the heat transferable sheet 1 such as: (1) the kind of the grade, size, etc., of the heat transferable sheet 1 can be detected; (2) the correctness of the front or the back during setting of the heat transferable sheet 1 can be detected; and (3) the direction of the heat transferable sheet 1 can be detected. The above photoelectric tube detection marks can be provided by use of the same material, the formation method, etc., for the photoelectric tube detection marks known in the art.

Also, other than such detection marks, discrimination is also possible by use of magnetic discrimination marks or shapes such as notch, etc.

Preparation method

As shown in FIG. 2, when in the cse of using a laminate having the synthetic papers 2 laminated on both surfaces of the core material 3, after plastering respectively the synthetic papers 2 and the core material 3, the receptive layer 5 may be formed with provision of an intermediate layer 6 or directly without such provision. However, as shown in FIG. 1, in the case of constituting a substrate sheet 4 by laminating the synthetic paper 2 only on one surface of the core material 3, it is preferable to use the method in which, first, the surface of the synthetic paper is coated with an ink composition for formation of a receptive layer followed by drying by heating to form a receptive layer on the surface of the synthetic paper, and subsequently a core material is laminated directly or over an intermediate layer on the surface of the synthetic layer where the receptive layer is not formed. By coating an ink composition for formation of a receptive layer on the surface of the synthetic paper 2 after laminating the synthetic paper 2 and the core material 3 and drying the coating at 100° C. or higher, there is a tendency of curling with a synthetic paper surface on the inner side by heat shrinkage of the synthetic paper 2. Accordingly, for prevention of generation of such curling, as described above, it is preferable to laminate the core material 3 after formation of the receptive layer 5 on the surface of the synthetic paper 2.

On the other hand, in the case of forming a resin layer 7 shown in FIG. 4, it is preferable to provide a resin layer 7 previously on the core material surface before laminating.

As the method for laminating the synthetic paper 2 and the core material 3, for example, laminating by use of adhesives known in the art, laminating by use of the extrusion lamination method, or laminating by hot melt adhesion may be used. Also, when the core material 3 is a plastic film, the lamination method simultaneously with formation of said core material 3 and laminating according to the calendering method can be practiced. The above laminating method is selected suitably depending on the materials of the synthetic paper 2 and the core material 3, etc. Specific examples of the above adhesive are emulsion adhesives such as of ethylene-vinyl acetate copolymers, polyvinyl acetates, and water-soluble adhesives of polyesters containing carboxylic groups. On the other hand, examples of the adhesive for lamination are adhesives of the type of organic solvent solutions of polyurethane type, and acrylic type polymers. It is preferable to apply these adhesives onto the surface of the core material or the synthetic paper and bonding both as they are or after light drying under a low nip pressure.

As a method for forming the receptive layer 5, it can be formed by use of the above resins by performing coating according to the coating method such as air knife coating, reverse roll coating, gravure coating or wire bar coating, followed by drying.

The present invention will now be described in more detail by way of Examples, but the present invention is not intended to be limited by the descriptions in these Examples. Throughout these Examples, quantities expressed in "part(s)" are by weight.

EXAMPLE 1

One surface of a synthetic paper having microvoids (thickness of 60 μm, produced by Oji Yuka Synthetic Paper Co. Ltd., Japan: Yupo FPG, overall density 0.77) was coated with an aqueous polyethylene solution (produced by Seitetsu Kagaku, Japan under the trade name of Zaiksen N) (coated amount on drying 10 g/m$^2$), which step was followed by drying. Then on its surface was superposed a fine paper (basis weight 85 g/m$^2$) and the laminate was bonded by pressing between hot rolls at a temperature of 90° C. Further, on the surface of the fine paper having no synthetic paper bonded thereon, the above aqueous polyethylene solution was applied and dried, and the same synthetic paper as the above synthetic paper was similarly laminated thereon to form a substrate. Next, on one synthetic paper surface of the above substrate, a composition for formation of a receptive layer having the following composition was applied by a wire bar and dried to provide a receptive layer with a coated amount on drying of 8 g/m$^2$, thus providing a heat transferable sheet.

Composition for formation of receptive layer:

Polyester resin (produced by Toyobo Co. Ltd., Japan: Vylon 200): 10 parts

Amino-modified silicone (produced by Shin-Etsu Chemical Co. Ltd., Japan: KF-393): 0.5 parts Epoxy-modified silicone (produced by Shin Etsu Chemical Co. Ltd., Japan: X-22-343): 0.5 parts Solvent (toluene/methyl ethyl ketone=1/1): 89 parts On the other hand, on a polyethylene terephthalate film with a thickness of 6 μm, an ink composition for formation of a heat-resistant slip layer having the following composition was prepared and applied by a wire bar #6. Then drying in hot air was carried out. In composition for formation of heat-resistant slip layer:

Polyvinyl butyral resin (Eslec BX-1): 4.5 parts
Toluene: 45 parts
Methyl ethyl ketone: 45.5 parts
Phosphoric acid ester (produced by Daiichi Kogyo Seiyaku, Japan: Plysurf A-208S): 0.45 part
Diisocyanate "Takenate D-110N" 75% ethyl acetate solution: 2 parts The above film was cured by heating in an oven at 60° C. for 12 hours. The amount of ink coated after drying was about 1.2 g/m$^2$. Next, on the surface of the above film opposite to the heat-resistant slip layer, an ink composition for formation of a heat-sensitive sublimation transfer layer having the following composition was prepared and applied by a wire bar #10 (coated amount about 1.2 g/m$^2$), which step was followed by drying in hot air to form a transfer layer, thus providing a heat transfer sheet.

Ink composition for heat-sesitive sublimation transfer layer:

Disperse dye (produced by Nippon Kayaku Co. Ltd., Japan: Kayaset Blue 714): 4 parts
Polyvinyl butyral resin (Eslec BX-1): 4.3 parts
Toluene: 40 parts
Methyl ethyl ketone: 40 parts
Isobutanol: 10 parts With the receptive layer of the heat transferable sheet obtained above being faced to the transfer layer of the above heat transfer sheet, the backside of the heat transfer sheet was heated with the thermal head by a thermal printer to effect image formation so that the maximum image density could be obtained. As a result, the image obtained was free from roughness, the image density was also good and substantially no curling of the heat transferable sheet having the image formed thereon was confirmed.

EXAMPLE 2

The glossy surface of a cast coated paper (basis weight 84 g/m$^2$) was coated with an organic solvent solution of a polyurethane resin-polyisocyanate type adhesive (coated amount on drying 10 g/m$^2$), which step was followed by drying, and on its surface was bonded a synthetic paper having microvoids (thickness 50 μm, produced by Oji Yuka Synthetic Paper Co. Ltd., Japan: Yupo FPG). Also, on the opposite surface of the cast coated paper, the same synthetic paper as above was similarly bonded to provide a substrate. Next, on the synthetic paper of the above substrate, a solution of a polyester resin (produced by Toyobo Co. Ltd., Japan: Vylon 200) in a solvent mixture of toluene/methyl ethyl ketone=1/1 was applied by use of a wire bar (coated amount on drying 7 g/m$^2$) and dried to form an intermediate layer. Next, on the above intermediate layer, an ink composition for formation of a receptive layer having the following composition was applied according to the reverse roll system (coated amount on drying 4 g/m$^2$) and then dried to form a receptive layer. Ink composition for formation of receptive layer:

Polystyrene resin (produced by Hercules: Picotex 100): 15 parts
Toluene/methyl ethyl ketone=1/1 solvent mixture: 75 parts
Amino-modified silicone oil (produced by Shin-Etsu Chemical Co. Ltd., Japan: KF393): 5 parts
Epoxy-modified silicone oil (produced by Shin Etsu Chemical Co. Ltd., Japan: X-22-343): 5 parts Next, on the surface of the above substrate on the side having no receptive layer, a toluene/methyl ethyl ketone=1/1 solution of a polymethyl methacrylate type resin (concentration 12%) was applied by use of a wire bar (coated amount on drying 4 g/m$^2$) and dried to form a resin layer. Next, on the above resin layer. a 1% isopropanol solution of an antistatic agent (produced by Analytical Chemical Laboratory of Scoky, Japan: Staticide) was applied (coated amount on drying 0.1 g/m$^2$) and then dried to obtain a heat transferable sheet.

When an image was formed on the heat transferable sheet obtained by use of a heat transfer sheet in the same manner as in Example 1, the image was free from roughness, and the image density was also good. Substantially no curling of the heat transferable sheet was observable.

EXAMPLE 3

One surface of a synthetic paper (thickness 60 μm, produced by Oji Yuka Synthetic Paper Co. Ltd., Japan: Yupo) was coated with a solution of chlorinated polypropylene in a solvent mixture of toluene/methyl ethyl ketone (weight ratio 1/1) as the primer layer (coated amount on drying 0.5 g/m$^2$), and a synthetic paper and a fine paper (basis weight 105 g/m$^2$) were dry laminated with the use of urethane type adhesive to form a substrate. Next, on the fine paper surface of the above substrate, a liquid having clay mixed and dispersed into a styrene-butadiene latex (solid weight ratio 1:2) was applied by use of a wire bar (coated amount on drying 8 g/m$^2$) and dried to form a resin layer. Subsequently, the same intermediate layer as in Example 2 was provided on the synthetic paper side of the above substrate (coated amount on drying 5 g/m$^2$), and further on the intermediate layer was formed the same receptive layer as in Example 1 (coated amount on drying 3 g/m$^2$) to obtain a heat transferable sheet.

When an image was formed by transfer on the heat transferable sheet obtained by use of a heat transfer sheet in the same manner as in Example 1, substantially no curling of the heat transferable sheet was observable.

EXAMPLE 4

By use of a synthetic paper having very little microvoids prepared according to the pigment coating system (thickness 110 μm, produced by Nisshinbo Ind. Inc., Japan: Peachcoat WP-110, overall density 0.88) as the synthetic paper, a heat transferable sheet having the same constitution as described in Example 2 was formed.

When an image was formed by transfer on the heat transferable sheet obtained by use of a heat transfer sheet in the same manner as in Example 1, little curling occurred, but the image suffered slightly from variance as compared with a synthetic paper having microvoids as used in Example 1, with inferior sharpness of the photographic image.

EXAMPLE 5

The glossy surface side of a synthetic paper (thickness 60 μm, produced by Oji Yuka Synthetic Paper Co. Ltd., Japan: Yupo SGG, overall thickness 0.83) and a fine paper with a thickness of 100 μm were subjected to extrusion lamination by use of a resin having the following composition to form a substrate. Resin composition:

Polypropylene (produced by Mitsui Petrochemical Ind. Ltd., Japan: LA-221): 96 parts
Titanium (white): 4 parts Subsequently, the same receptive layer as in Example 1 was formed on the above substrate on the side of the synthetic paper to obtain a heat transferable sheet.

When an image was formed by transfer on the heat transferable sheet obtained by use of a heat transfer sheet in the same manner as in Example 1, substantially no curling of the heat transferable sheet was observed.

EXAMPLE 6

First, one surface of a fine paper with a thickness of 100 μm was coated with a resin having the following composition.

Resin composition:

Polypropylene (produced by Mitsui Petrochemical Ind. Ltd., Japan: LA-221): 96 parts Titanium (White): 4 parts Next, a synthetic paper (thickness 60 μm, produced by Oji Yuka Synthetic Paper Co. Ltd., Japan: Yupo FPG) and the above fine paper with the side coated with no resin contacted with the synthetic paper were subjected to extrusion lamination by using similarly the resin having the above composition to form a substrate. On the above substrate on the side of the synthetic paper, the same receptive layer as in Example 2 was formed by a heat transferable sheet. When an image was formed by transfer on the heat transferable sheet obtained by use of a heat transfer sheet in the same manner as in Example 1, substantially no curling of the heat transferable sheet was recognized and its quality was also good.

EXAMPLE 7

In Example 5, the fine paper with a thickness of 100 μm was changed to a oriented polypropylene with a thickness of 100 μm, and, following otherwise the same procedure as in Example 5, image formation was carried out on the receptive layer of the heat transferable sheet. As a result, no curling was observed and the quality was also good.

EXAMPLE 8

In Example 6, the fine paper with a thickness of 100 μm was changed to an oriented polypropylene with a thickness of 60 μm, and following otherwise the same procedure as in Example 6, image formation was carried out on the receptive layer of the heat transferable sheet. As a result, no curling was observed and the quality was also good.

EXAMPLE 9

On the substrate formed in Example 5 on the side of the fine paper surface, a synthetic paper (thickness 60 μm, produced by Oji Yuka Synthetic Paper Co. Ltd., Japan: Yupo FPG) was extrusion laminated by use of the same resin to form a substrate. Following otherwise the same procedure as in Example 4, image formation was carried out on the receptive layer of the heat transferable sheet, whereby no curling was observed and the quality was also good.

EXAMPLE 10

In Example 9, the fine paper with a thickness of 100 μm was changed to an oriented polypropylene with a thickness of 60 μm, and, following otherwise the same procedure as in Example 9, image formation was carried out on the receptive layer of the heat transferable sheet. As a result, no curling was observed and the quality was also good.

EXAMPLE 11

One surface of synthetic paper having microvoids (thickness 110μ, produced by Oji Yuka Synthetic Paper Co. Ltd., Japan: Yupo FPG) was coated on the whole surface by a gravure solid (full) plate with a 5% ethyl acetate solution of a chlorinated polypropylene as the primer (coated amount on drying 0.3 g/m$^2$), and a composition for formation of a receptive layer having the following composition was applied according to the reverse roll system by use of a plate cylinder of the solid plate of a dashed plate and then dried (coated amount on drying 6 g/m$^2$). After seasoning for 7 days, the coated product was further subjected to heat treatment at 120° C. for 2 minutes, to provide a receptive paper. By the heat treatment, shrinkage occurred by 0.4% in the width direction.

Composition for formation of receptive layer:

Polyester resin (produced by Toyobo Co. Ltd., Japan: Vylon 200): 100 parts

Amino-modified silicone (produced by Shin-Etsu Chemical Co. Ltd., Japan: KF-393): 7 parts Epoxy-modified silicone (produced by Shin-Etsu Chemical Co. Ltd., Japan: X-22-343): 7 parts Toluene/methyl ethyl ketone (weight ratio 1/1): 700 parts On the other hand, one surface of a commercially available coated paper (thickness 65 μm) was coated with a solution of a polyurethane type adhesive diluted with a toluene/methyl ethyl ketone solvent mixture (weight ratio 1:1), and after evaporation of the solvent by a hair dryer, the non-receptive surface of the above receptive paper was laminated to produce a heat transferable sheet. This heat transferable sheet was substantially without curling at normal temperature and normal humidity, but curling (curling height 15 mm) occurred under the environment of 60° C. When printing was performed by a heat sensitive printer by use of a heat transfer sheet, no curling after printing was observed.

EXAMPLE 12

In place of the commercially available coated paper of Example 11, a fine paper (thickness 65 μm) subjected to extrusion coating of a polypropylene (coating thickness 15 μm) was coated on the non-coating surface with an ethylene-vinyl acetate emulsion type adhesive, and, after drying by a hair dryer, it was laminated on the same receiving paper as in Example 11 to obtain a heat transferable sheet.

The heat transferable sheet was of course free from curling at normal temperature and normal humidity, and also was substantially without curling under the environment of 90% RH at 60° C. and 40° C.

EXAMPLE 13

One surface of a synthetic paper having microvoids (thickness 110 μm, produced by Oji Yuka Synthetic Paper Co. Ltd., Japan: Yupo FPG) was subjected to a chlorinated PP type primer coating, and, after drying, a receptive layer was formed by coating the same ink composition for formation of receptive layer as in Example 12 (coated amount on drying 7 g/m$^2$) according to the reverse roll system and drying the coating at 120° C. for 5 minutes.

Next, the non-glossy surface of a cast coated paper (basis weight 105 g/m$^2$) was coated with the same polymethyl methacrylate type resin as in Example 2, which was then dried, and the same antistatic agent as in Example 2 was applied thereon and dried.

After a polyurethane resin-polyisocyanate type adhesive was applied and dried on the glossy surface of the cast coated paper, it was brought into contact with the synthetic paper provided with the receptive layer on the surface where no receptive layer was provided, and laminated by pressing between rolls to produce a heat transferable sheet.

The above heat transferable sheet of Example 12 was free from curling by printing, but curling was observed before printing (curling height 12 mm with the size of 100 mm×128 mm) and the curling remained as such even after printing. However, no curling by printing was observed. On the other hand, the heat transferable sheet of this Example 13 was substantially free from curling before printing (curling height 3 mm), and its flatness was retained even after printing, no curling by printing being observable.

EXAMPLE 14 (FORMATION OF RECEPTIVE LAYERS ON BOTH SURFACES)

On both surfaces of a coated paper (thickness 65 μm) were laminated synthetic papers (thickness 60 μm, produced by Oji Yuka Synthetic Co. Ltd., Japan: Yupo (FPG) with a polyurethane-isocyanate type adhesive, and on one surface was provided a receptive layer (b) with the use of a composition for formation of receptive layer (B) shown below, while on the opposite surface was applied a composition for formation of receptive layer (C) having the following composition by use of a wire bar and dried to provide a receptive layer (c) with a coated amount on drying of 5 g/m$^2$, thus providing a heat transferable sheet capable of printing on both surfaces.

Composition for formation of receptive layer (B):
Polystyrene resin (produced by Denki Kagaku Kogyo, Japan: MT-2): 10 parts
Amino-modified silicone (produced by Shin-Etsu Chemical Co. Ltd., Japan: KF-393): 0.5 part
Epoxy-modified silicone (produced by Shin-Etsu Chemical Co. Ltd., Japan: X-22-343): 0.5 part
Solvent (toluene/methyl ethyl ketone=1/1): 89 parts
Composition for formation of receptive layer (C):
Vinyl chloride-vinyl acetate (produced by Union Carbide Co.: Vinylite VYHH): 10 parts
Amino-modified silicone (produced by Shin-Etsu Chemical Co. Ltd., Japan: KF-393): 0.5 part
Epoxy modifed silicone (produced by Shin-Etsu Chemical Co. Ltd., Japan: X-22-343): 0.5 part
Calcium carbonate: 3 parts
Solvent (toluene/methyl ethyl ketone=1/1): 89 parts For examination of blocking characteristic, two sheets of the heat transferable sheet obtained above were mutually superposed on one another so that the front side of one sheet and the back side of the other sheet contacted each other and were left to stand in an environment of a temperature of 50° C. under a load of 2 kg/cm$^2$ for 10 days. As a result, no blocking occurred to give good result. Then, similarly as described in Example 1, images were formed on the receptive layer (b) surface and the receptive layer (c) surface. As the result, both images on both surfaces exhibited good sharpness without roughness of intermediate tone.

EXAMPLE 15

On both surfaces of a polyethylene terephthalate film (thickness 100 μm) synthetic papers (thickness 50 μm, produced by Oji Yuka Synthetic Paper Co. Ltd, Japan: Yupo FPG) were laminated with a polyurethane-isocyanate type adhesive. On one of the surfaces, a receptive layer (a) was provided by use of the composition (A) shown below, while the other surface was coated with the composition (d) for formation of a receptive layer with the composition shown below by use of a wire bar which was then dried to provide a receptive layer (d) with a coated amount on drying of 10 g/m$^2$.

Composition (A) for formation of receptive layer:
Polyester resin (produced by Toyobo Co. Ltd., Japan: Vylon 200): 10 parts
Amino-modified silicone (produced by Shin-Etsu Chemical Co. Ltd., Japan: KF-393): 0.5 part
Epoxy-modified silicone (produced by Shin-Etsu Chemical Co. Ltd, Japan: X-22-343): 0.5 part
Solvent toluene/methyl ethyl ketone=1/1): 89 parts
Composition (D) for formation of receptive layer:
Polyester resin (produced by Toyobo Co. Ltd., Japan: Vylon 200): 10 parts
Clay: 7 parts
Solvent (toluene/methyl ethyl ketone=1/1): 83 parts Further, on the receptive layer (d), a composition comprising a 3% toluene solution of a silicone for mold release (produced by Shin-Etsu Chemical Co. Ltd., Japan: KS-778) having a curling accelerated reagent added therein was applied and dried (coated amount on drying 0.1 g/m$^2$) to produce a heat transferable sheet having receptive layers on both surfaces.

This sheet was left to stand under a load similarly as in Example 14, and its blocking property was examined, whereupon good results without occurrence of blocking were obtained. Then, when images were formed on the receptive layer (c) surface and the receptive layer (d) surface in the same manner as in Example 1, both images on both the surfaces exhibited good sharpness without roughness of intermediate tone.

What is claimed is:

1. A sheet to be heat transfer printed which is to be used in combination with a heat transfer sheet, comprising a receptive sheet having:
a substrate sheet; and
a receptive layer for receiving a dye transferred from the heat transfer sheet upon being heated, said receptive layer comprising a resin:
said substrate sheet comprising a laminate having a synthetic paper laminated on at least one surface of a core material comprising a cellulose fiber paper, and said receptive layer being provided directly or over an intermediate layer on the surface of the substrate sheet on the side where the synthetic paper is disposed.

2. A sheet to be heat transfer printed according to claim 1, wherein said synthetic paper comprises a synthetic paper having on its surface a paper-like layer containing microvoids.

3. A sheet to be heat transfer printed according to claim 1, wherein said synthetic paper comprises a pigment-filled low density extruded film.

4. A sheet to be heat transfer printed according to claim 1, wherein a resin layer is provided on the surface of the substrate sheet on the side where no receptive layer is provided.

5. A sheet to be heat transfer printed according to claim 1, to which an antistatic treatment has been applied on the surface of the substrate sheet.

6. A sheet to be heat transfer printed according to claim 1, wherein an antistatic layer is provided on the substrate sheet on the side where no receptive layer is provided.

7. A sheet to be heat transfer printed according to claim 1, wherein a mold release agent layer is provided on the surface of the receptive layer.

8. A sheet to be heat transfer printed according to claim 1, wherein receptive layers are provided on both surfaces of the substrate sheet.

9. A sheet to be heat transfer printed according to claim 8, wherein the resin constituting the receptive layer on one surface and the resin constituting the receptive layer on the other surface are mutually non-blocking with respect to each other.

10. A sheet to be heat transfer printed according to claim 8, wherein the receptive layers formed on both the surfaces are constituted of resins which are mutually different from each other.

11. A sheet to be heat transfer printed according to claim 11, wherein the receptive layer is formed partially on the substrate sheet.

12. A sheet to be heat transfer printed according to claim 1, wherein a non-receptive layer for writing is partially provided on the surface of the receptive layer.

13. A sheet to be heat transfer printed according to claim 1, which is obtained by coating the surface of a synthetic paper with an ink composition for formation of a receptive layer and thereafter drying by heating the coating to form a receptive layer on the surface of the synthetic paper, and subsequently laminating a core material on the surface of the synthetic paper where no receptive layer is formed.

14. A sheet to be heat transfer printed according to claim 1, wherein a lubricant layer is provided on the outermost layer of the substrate sheet on the side where no receptive layer is provided.

15. A sheet to be heat transfer printed according to claim 1, wherein a detection mark is provided on the surface of the core material of the substrate sheet.

16. A sheet to be heat transfer printed according to claim 1, wherein the surface of the receptive layer has been subjected to a super-calendering treatment.

* * * * *